US005570790A

United States Patent [19]

Rumpf et al.

[11] Patent Number: 5,570,790

[45] Date of Patent: Nov. 5, 1996

[54] STRAINER HAVING A MAIN SCREEN AND A FORE SCREEN

[75] Inventors: Wolfhard Rumpf; Werner Schwarzkopf, both of Rödermark, Germany

[73] Assignee: Dietrich Reimelt KG, Rödermark/Urberach, Germany

[21] Appl. No.: 307,369

[22] Filed: Sep. 16, 1994

[30] Foreign Application Priority Data

Sep. 18, 1993 [DE] Germany ..... 43 31 782.0

[51] Int. Cl.[6] ..... B07B 1/22

[52] U.S. Cl. ..... 209/291; 209/299; 209/300; 209/683

[58] Field of Search ..... 209/284, 288, 209/289, 291, 294, 299, 300, 379, 385, 389, 683, 687; 198/661, 670

[56] References Cited

U.S. PATENT DOCUMENTS

| | | | |
|---|---|---|---|
| 1,973,864 | 9/1934 | Biffar | 209/300 X |
| 3,394,808 | 7/1968 | Thompson | 209/291 X |
| 3,756,406 | 9/1973 | Khan | 209/291 |
| 4,115,257 | 9/1978 | Mugler | 209/291 |
| 4,202,759 | 5/1980 | Krolopp | 209/234 |
| 4,582,202 | 4/1986 | Stone et al. | 209/291 X |
| 5,052,874 | 10/1991 | Johanson | 198/661 X |

FOREIGN PATENT DOCUMENTS

| | | | |
|---|---|---|---|
| 0126177 | 11/1984 | European Pat. Off. . | |
| 9209985 | 9/1992 | Germany . | |
| 1258498 | 9/1986 | U.S.S.R. | 209/291 |

*Primary Examiner*—William E. Terrell
*Assistant Examiner*—Tuan Nguyen
*Attorney, Agent, or Firm*—Darby & Darby, P.C.

[57] ABSTRACT

A strainer comprises a housing. A main screen is disposed within the housing. The fore screen is disposed within the housing and includes a first section and a second section. A main beater is connected to the second section of the fore screen. The fore screen and the main beater are moveable with respect to the main screen. An auxiliary beater is connected to the second section of the fore screen. The auxiliary beater is moveable with respect to the first section of the fore screen.

12 Claims, 2 Drawing Sheets

STRAINER HAVING A MAIN SCREEN AND A FORE SCREEN

FIELD OF THE INVENTION

The present invention relates to a strainer. More specifically, the present invention relates to a strainer having a housing with a main screen and a fore screen mounted in the housing. The fore screen carries a main beater mechanism, which is movable with respect to the main screen.

BACKGROUND OF THE INVENTION

During the processing of powder and granular shaped bulk materials, for example, in the food or pharmaceutical industries, it often becomes necessary to free these bulk materials from unwanted foreign bodies. It is especially important to eliminate these foreign bodies from products which are intended to be used for human consumption. These foreign bodies originate at various sources. One often might find stones which were picked up at the harvest of grain or other agricultural products. At other times, there may be nutshells which were not entirely removed when the nuts were shelled. Under certain circumstances, one could even find screws, nuts and bolts which, during the transport of the bulk material, found their way into the bulk material. Accordingly, it has been necessary to strain bulk materials to remove these foreign bodies before additional processing can be performed. To accomplish this, a strainer or screen with the required mesh size has been used. The material is placed in the strainer and through motions of the strainer, perhaps a vibration or movement of the material above the strainer, e.g., by using a main beater mechanism, a portion of the bulk material which has the necessary fineness, will move through the strainer. The foreign bodies are retained by the strainer and can be removed. Of course, it is possible that heavier foreign bodies could hit the strainer with such an impact force that the strainer might get damaged. When this happens, the foreign bodies will wind up with the bulk material that was supposed to be designated as the cleaned portion. Thus, after the strainer is damaged, the resulting yield of the straining device will not be maintained in the required quality range.

U.S. Pat. No. 4,202,759 discloses a straining device of the type discussed above and includes an additional screen. This additional screen serves simultaneously as a carrier for a beater mechanism. That is, a mechanism which causes the relative motion of the material to be strained. The screen rotates with respect to the main screen with a rotational speed of approximately 700 r.p.m., thereby causing the bulk material to be strained through the additional screen, mainly by centrifugal force. Although the additional screen does provide the benefit of keeping larger foreign bodies away from the main strainer, there is a tendency for certain bulk materials to clog. This is true with many powder and granular materials, especially if they are exposed to a certain amount of humidity. In many cases, an incorrect control setting of the air humidity in the atmosphere surrounding the strainer will cause the formation of lumps in the bulk material. Once the material has formed lumps, it can no longer be strained through the additional screen by centrifugal force alone and this additional screen will quickly clog up, thereby preventing the further use of the strainer without maintenance.

SUMMARY OF THE INVENTION

A principle object of the present invention is to provide a strainer for universal use. The present invention achieves this object with a strainer which divides the fore screen into a first and a second section. The second section carries the main beater mechanism and is movable with respect to the first section. The second section is also provided with an auxiliary beater, which is also movable with respect to the first section. By dividing the fore screen, the fore screen can be equipped with a beater so that the materials to be strained can be pressed through the fore screen by external forces. Additionally, the fore screen, particularly the second and movable section, can be used as the carrier of the main beater mechanism and thereby simultaneously provide a beater mechanism for the main screen yet cause no major support problems. In the second section of the fore screen only centrifugal force is utilized to strain the bulk material. Because the first section includes an auxiliary beater mechanism, its flow capacity is sufficient to prevent a clogging of the strainer, even for bulk materials which have a tendency to lump. The relative length of the first and the second section of the fore screen can be selected arbitrarily. One need only make sure that the main beater mechanism is adequately supported over its length and that it does not cause undesirable vibration or excessive strain to either itself or to the housing.

In a preferred embodiment of the present invention, the first section is arranged in a housing so that it is fixed and immovable in the housing and does not require additional bearings or seals. Thus, in comparison to an undivided fore screen, the present invention does not require any additional bearings or seals. Therefore, the bearings and seals can be seated in the housing end walls as they are in conventional strainers.

Because the second section and the auxiliary beater mechanism share a common drive, the auxiliary beater mechanism does not need a separate drive. It is therefore possible to arrange for synchronous motion of the auxiliary beater mechanism and the second section of the fore screen, which also means that the motion of the auxiliary beater mechanism and the main beater mechanism are synchronized. The conveying capacity of the auxiliary and the main beater mechanism can thereby be matched in a very simple manner.

Preferably, the main and the fore screens are designed as cylindrical drums and the second section of the fore screen rotates around a cylindrical axis. In this preferred arrangement, the first section of the fore screen is fixed and coaxial with respect to the second section. Through rotation of the second section a continuous motion of the main beater mechanism with respect to the main strainer can be produced while the second section of the fore screen is moving with respect to the material to be strained.

In a preferred embodiment, the drive is achieved by means of a shaft which is located near the inlet of the fore screen and extends to an inlet opening of the housing and is at least partially designed as a screw conveyor device. A screw conveyor device is not only to be understood as a screw conveyor, but also may be a helical projection mounted on a shaft. The screw conveyor device can also be formed by protruding partitions on the shaft, which could, for example, form an interrupted helical shape. Whatever type of screw conveyor device is used, the important function is simply that a conveying force is imparted to the bulk material to create a transfer of the material through the strainer. The rotational motion of the shaft continues in the second section of the fore screen. To drive the second section of the fore screen and to thereby also drive the main beater mechanism, no separate driving mechanism is required. Therefore, the feeding of the bulk material into the fore screen and the main beater mechanism happen simultaneously.

The screw conveyor device preferably extends into the first section of the fore screen and functions as an auxiliary beater mechanism. The relative motion between the first section of the fore screen and the auxiliary beater mechanism is axial, so that the bulk material to be strained, which does not pass through the first section is immediately removed from the first section of the fore screen. Clogging of the first section of the fore screen is thereby reliably prevented.

It is especially preferred, to arrange the first section ahead or upstream of, as viewed in the conveying direction, the second section of the fore screen. The portion of the bulk material to be strained, which is not strained in the first section of the fore screen, then enters through the second section of the fore screen. Thus, a more efficient use of the entire strainer surface of the fore screen is achieved.

It is also especially preferred that the screw conveyor device provides, at least in the area of the first section of the fore screen, a larger conveyor capacity than in the area of the inlet opening. The bulk material will therefore accelerate in the area of the first section of the fore screen. The material discharged into the first section of the fore screen will be thrown into the second section of the fore screen. Thus, a better distribution of bulk material in the second section of the fore screen is achieved.

In other preferred embodiments of the present invention, the auxiliary beater mechanism can include paddles, which essentially extend in an axial and a radial direction. These paddles can be utilized alone or they can be used in addition to the screw conveyor of the auxiliary beater mechanism. The paddles run essentially in a circumferential direction without requiring a larger axial movement for the bulk materials. Due to the use of the paddles, the center of gravity of the straining effect is moved closer to the first section of the fore screen. This may be especially advantageous when a bulk material, which has a greater tendency to lump, is being processed.

The main beater mechanism includes a stripper disposed on the outlet side of the first section of the fore screen. Because the first section of the fore screen is fixed, the danger exists that material could accumulate on the first section's outlet or downstream side. When a cylindrical main screen is disposed adjacent to the outer surface of the fore screen, material accumulation could prevent additional material from passing through. This problem usually occurs in the upstream area of the fore screen, where the material cannot drop due to gravity. Accordingly, by using a stripping device, the outlet side of the fore screen gets cleaned regularly, thereby preventing material accumulation and potential blockages.

A gap is preferably disposed between the first and the second sections of the fore screen. The width of the gap preferably does not exceed the largest width of a fore screen opening. The gap is sized such that no blockage occurs during movement of bulk material from the first section of the fore screen to the second. The gap can also serve as one of the strainer openings.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENT INVENTION

Figure 1:
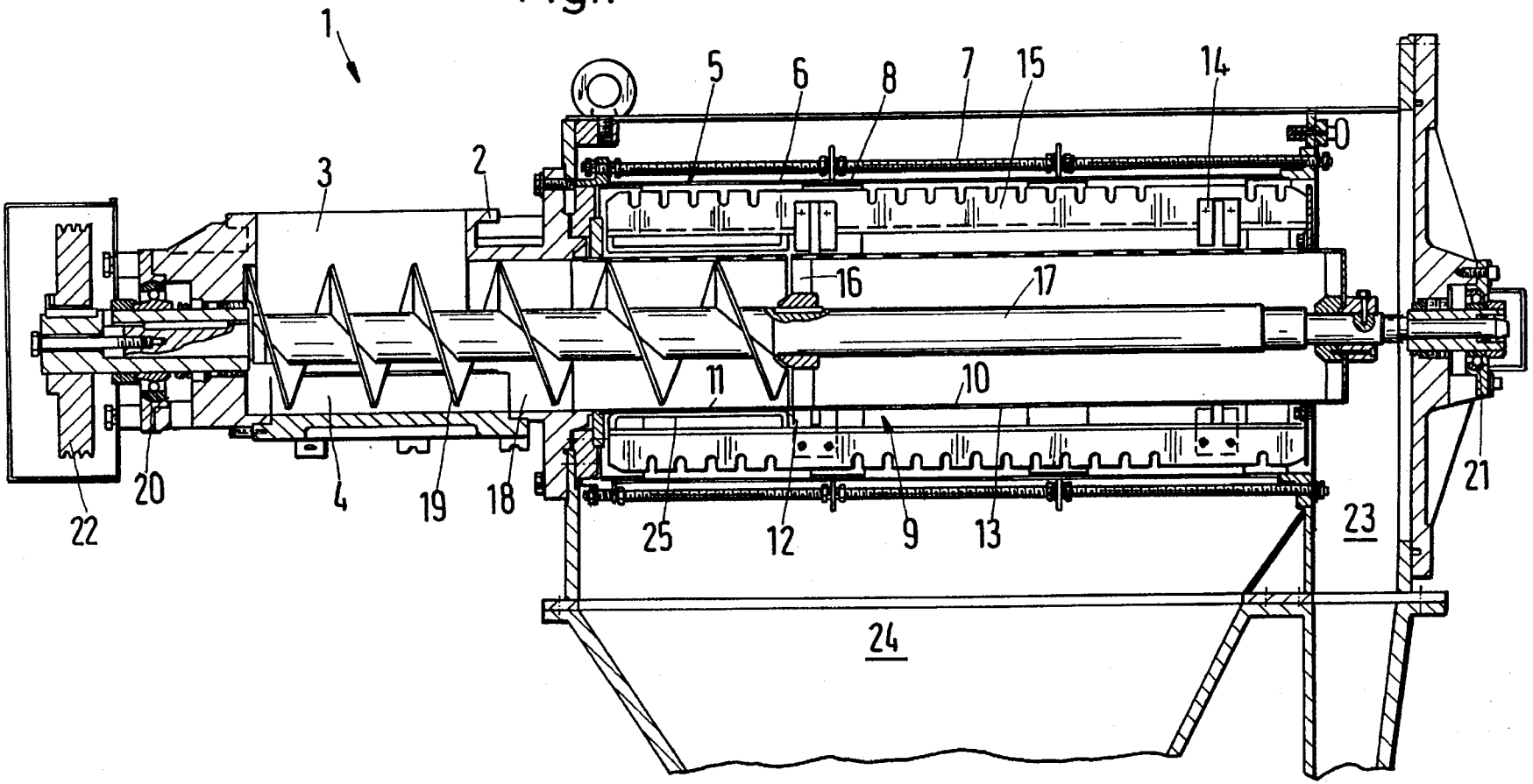
FIG. 1 shows a strainer according to a first embodiment of the present invention.

Referring now to FIG. 1, a strainer apparatus 1 is shown having an inlet opening 3. The strainer includes a housing 2. The inlet opening 3 discharges into an inlet chamber 4.

A main strainer 5 is disposed in housing 2. Main strainer 5 is fixed with respect to housing 2. The main strainer 5 includes a mesh strainer 6 which, with the aid of a tension device 7 is stretched axially, and with the aid of tension rings 8 is stretched radially.

The main strainer or screen 5 is formed in the shape of a hollow cylinder. A fore screen 9 is disposed coaxially to the main strainer 5. Fore screen 9 is separated into a first section 11 and a second section 10. The fore screen has a plurality of through openings 13. A gap 12 is disposed between sections 10 and 11. The width of gap 12 approximately corresponds to or is less than the width of the largest fore screen opening 13.

A holder 14 is disposed on the second section 10 of the fore screen 9. A main beater mechanism 15 is mounted on the circumference of holder 14. Main beater mechanism 15 is disposed adjacent to main strainer 5, and is movable with respect to main strainer 5.

A shaft 17 is fastened to the second section 10 of the fore screen 9 by a star shaped mounting member 16. Shaft 17 can rotate in bearings 20, 21, which are seated in the end walls of housing 2. When shaft 17 is rotated, the second section 10 of the fore screen 9 also rotates. Rotation of second section 10 causes main beater mechanism 15 to move (i.e., rotate) with respect to main strainer 5.

First section 11 of the fore screen 9 is fixed with respect to housing 2. First section 11 is also in the shape of a hollow cylinder and has a diameter that is approximately equal to the diameter of second section 10. First section 11 forms a continuation of channel 18 and therefore connects first section 11 with the inlet chamber 4. Channel 18 has approximately the same inside diameter as fore screen 9. However, the diameter of the fore screen could be larger.

A screw conveyor device or auger 19 is disposed such that it is located both in the inlet chamber 4 and within the first section 11 of the fore screen 9. The screw conveyor device 19 is fixed to the shaft 17. Accordingly, when shaft 17 rotates, due to a rotational force received from a drive pulley 22, which is mounted at one of the shaft's axial ends, auger 19 also rotates. A pulverized or granular spillable material enters the inlet chamber 4, via the inlet opening 3. With the aid of the screw conveyor device 19, the material is transported or conveyed through channel 18 into first section 11. During this operation, the screw conveyor device 19 functions as an auxiliary beater mechanism in the interior of the first section 11. Screw conveyor device 19 produces a relative movement of the materials to be strained with respect to the first section 11. This relative motion is essentially in the axial direction, but also has a small component in the circumferential or radial direction. Materials to be strained, which have not yet entered the first section 11, will enter this section due to the rotation of second section 10, which produces a centrifugal force, which together with an existing (at least at the start) relative motion between materials to be strained and the fore screen create the effect of permitting the materials to pass through the second section 10. Any material to be strained which does not pass through the fore screen will drop into a waste channel 23 adjacent to the rear axial end of the fore screen 9. That is, the end facing away or remote from the screw conveyor device 19. Waste channel 23 also receives the materials which do not pass through main strainer 5. However, the materials which have passed through the fore screen 9 and the main strainer 5 will drop into a collecting channel 24 and are transferred from there for further processing.

The screw conveyor device 19 has at its end which enters into the fore screen 9 a progressive conveying capacity. One example of such a progressive conveying capacity is illustrated in FIG. 1, where the thread pitch height increases between the individual windings of the screw conveyor 19. This progressive conveying capacity permits for the better spreading of the material to be strained in the first section 11 of the fore screen 9. The progressive conveying capacity permits the material to accelerate as it enters first section 11, such that the material is practically thrown into the second section 10. Thus, an improved distribution of the material to be strained in the second section 10 is achieved.

The main beater mechanism 15 extends substantially over the entire length of the main strainer 5. A small portion of the axial length also extends over the first section 11 of the fore screen 9. In this range the main beater mechanism 15 includes strippers 25, which are directed radially inward, and which clean the outlet side of the first section 11. The strippers 25 remove accumulation of material on the outlet side of first section 11, which is especially advantageous because strippers 25 prevent the material from dropping from the fore screen 9 due to the material's own weight (i.e., due to the force of gravity).

The proportion or ratio of the axial lengths of the second section 10 compared to the first section 11 depends in principle on the maximum possible free length that the main beater mechanism 15 can endure. This free length determines the axial length of the first section 11 of the fore screen 9. The length of the main beater mechanism is selected such that the main beater mechanism 15 is not exposed to undesirable vibrations nor is it overstressed during operation.

Figures 2, 3:
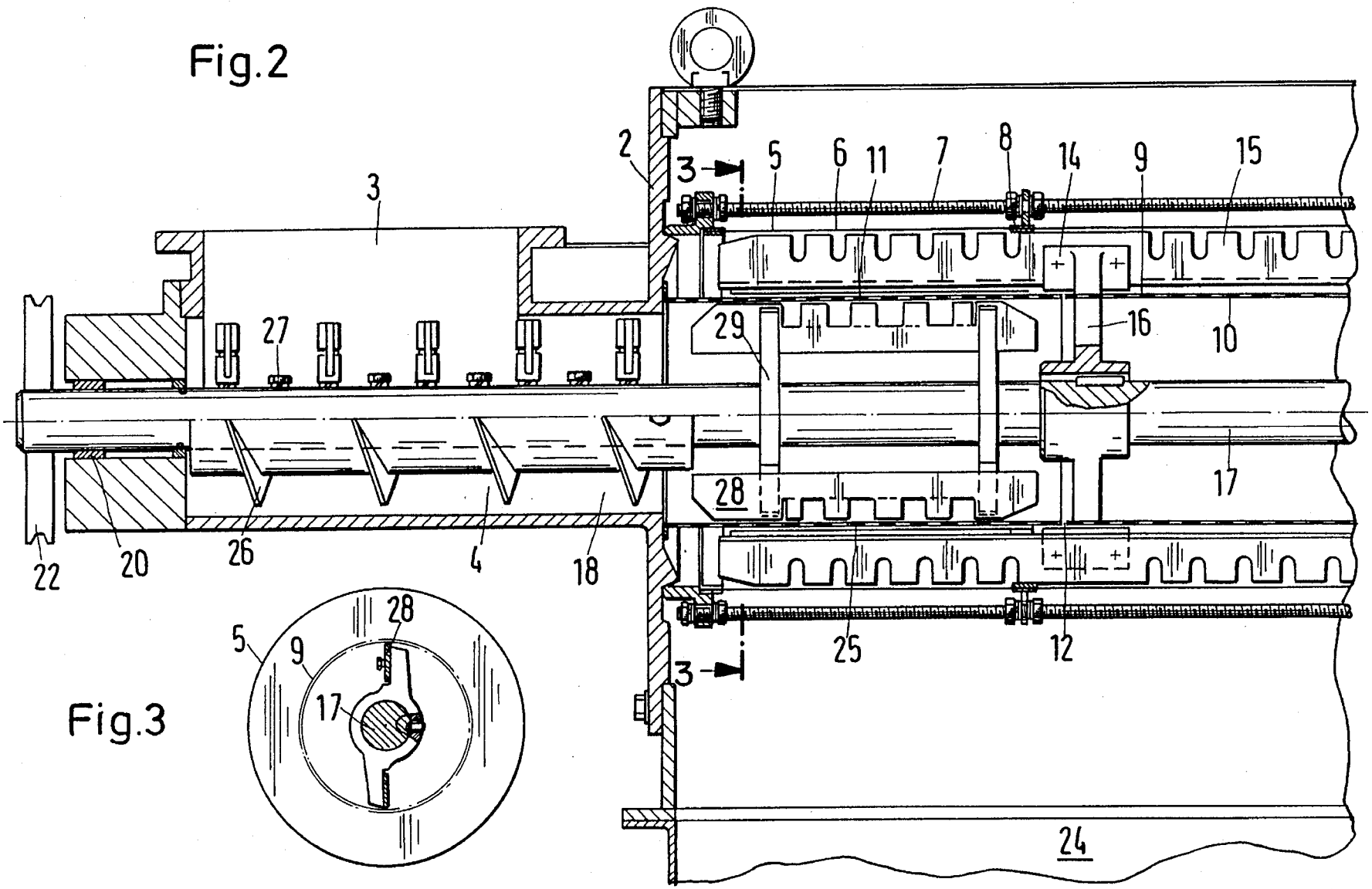
FIG. 2 shows a partial view of a strainer according to a second embodiment of the present invention.
FIG. 3 is a sectional view taken along line 3—3 in FIG. 2.

FIG. 2 and FIG. 3 show a modified embodiment of the present invention. Components which correspond to the ones in FIG. 1 are designated with the same reference numbers. For the sake of clarity, the main beater mechanism 15 with strippers 25 and the tension device 7 are not shown in FIG. 3.

The embodiment illustrated in FIGS. 2 and 3 differs from the embodiment illustrated in FIG. 1 in the design of the screw conveyor device. The screw conveyor device 19 of FIG. 1 has been replaced by a plurality of individual separation surfaces 26 which are shown in FIG. 2 in their entirety on the lower half of shaft 17 and in cross section in the upper half. These separation surfaces 26 are fastened to the shaft 17 by screws 27. After loosening the screws 27 the slope of the separation surfaces 26 can be adjusted and with it the conveying capacity of the screw conveyor device.

The auxiliary beater mechanism, which according to the FIG. 1 embodiment is formed by the part of the screw conveyor device 19 which protrudes into the first section 11 of the fore screen 9, also differs in this embodiment. The auxiliary beater mechanism is formed by a paddle 28. Paddle 28 extends in the axial and radial direction, and is fastened through carriers 29 to shaft 17. Paddle 28 imparts a general rotary motion to the material during a rotation of shaft 17. Thus, the material is redistributed substantially in the first section 11 before it enters the second section 10. Of course, the auxiliary beater mechanism can be used in combination with a screw conveyor device so that the movement imparted to the material includes both a rotary and an axial component.

In both embodiments, the first section 11 is arranged in the conveying direction of the materials to be strained ahead or upstream of the second section 10. This means that material to be strained flows first through first section 11 and then through second section 10 of the fore screen 9. Thus, the material to be strained which has a greater tendency to lump, will settle as soon as it contacts a strainer and will pass through the fore screen, while the loose parts of the material are strained in the second section 10 of the fore screen 9.

Having described the presently preferred exemplary embodiment of a new and improved strainer, in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

We claim:

1. A strainer comprising:

a housing;

a main screen being disposed within said housing;

a fore screen being disposed within said housing, said fore screen including a first section and a second section, said first section of said fore screen being fixed with respect to said housing;

a main beater being connected to said second section of said fore screen, said fore screen and said main beater being moveable with respect to said main screen; and an auxiliary beater being connected to said second section of said fore screen, said auxiliary beater being moveable with respect to said first section of said fore screen.

2. A strainer according to claim 1, wherein said second section of said fore screen and said auxiliary beater have a common drive.

3. A strainer according to claim 2, wherein said main screen and said fore screen each have a cylindrical drum shape and said second section of said fore screen rotates around a cylindrical axis.

4. A strainer according to claim 3, wherein said second section of said fore screen is driven by a shaft, said shaft is disposed, at least in part, adjacent to an inlet of the fore screen and extends to an inlet opening of the housing, and said shaft includes, for at least a part of its axial length, a screw conveyor device connected thereto.

5. A strainer according to claim 4, wherein the screw conveyor device extends into said first section of said fore screen, and said portion of said screw conveyor device that extends into said first section is said auxiliary beater.

6. A strainer according to claim 5, further including a material flow path being disposed through said housing, said first section and said second section defining a portion of said flow path such that said first section is disposed upstream of said second section.

7. A strainer according to claim 6, wherein said screw conveyor device, at least within said first section, has a larger conveyor capacity than in the inlet chamber.

8. A strainer according to claim 4, wherein the auxiliary beater includes a plurality of paddles, which extend in an axial and radial direction.

9. A strainer according to claim 6, wherein said main beater includes a stripper disposed on the downstream side of said first section.

10. A strainer according to claim 9, further including a plurality of openings in said fore screen, a gap being disposed between said second section and said first section, a width of said gap being less than or equal to a width of a largest fore screen opening.

11. A strainer comprising:

a housing;

a main screen being disposed within said housing;

a fore screen being disposed within said housing, said fore screen including a first section and a second section;

a main beater being connected to said second section of said fore screen, said fore screen and said main beater being moveable with respect to said main screen, said main beater includes a stripper disposed on the down stream side of said first section; and an auxiliary beater being connected to said second section of said fore screen, said auxiliary beater being moveable with respect to said first section of said fore screen.

12. A strainer comprising:

a housing;

a main screen being disposed within said housing;

a fore screen being disposed within said housing, said fore screen including a first section having a diameter and a second section having a diameter, said diameter of said first section being approximately equal to the diameter of said second section, said first section being approximately coaxial with said second section;

a main beater being connected to said second section of said fore screen, said fore screen and said main beater being moveable with respect to said main screen; and an auxiliary beater being connected to said second section of said fore screen, said auxiliary beater being moveable with respect to said first section of said fore screen.

* * * * *